US009989894B2

(12) United States Patent
Yamaguchi

(10) Patent No.: US 9,989,894 B2
(45) Date of Patent: Jun. 5, 2018

(54) IMAGE FORMING APPARATUS

(71) Applicant: CANON KABUSHIKI KAISHA, Tokyo (JP)

(72) Inventor: Hiroki Yamaguchi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days. days.

(21) Appl. No.: 15/645,769

(22) Filed: Jul. 10, 2017

(65) Prior Publication Data

US 2018/0024473 A1 Jan. 25, 2018

(30) Foreign Application Priority Data

Jul. 22, 2016 (JP) ..... 2016-144642

(51) Int. Cl.
*G03G 15/16* (2006.01)

(52) U.S. Cl.
CPC ..... *G03G 15/1605* (2013.01)

(58) Field of Classification Search
CPC ..... G03G 15/0136; G03G 2215/0193
See application file for complete search history.

(56) References Cited

U.S. PATENT DOCUMENTS

2007/0248382 A1* 10/2007 Oguma ..... G03G 15/0216 399/167
2007/0253730 A1* 11/2007 Matsubara ..... G03G 15/1685 399/121

FOREIGN PATENT DOCUMENTS

JP 2004-78212 A 3/2004
JP 2006-113283 A 4/2006
JP 2007-298545 A 11/2007

* cited by examiner

*Primary Examiner* — Victor Verbitsky
(74) *Attorney, Agent, or Firm* — Canon U.S.A., Inc. IP Division

(57) ABSTRACT

A separation member includes a contact surface contacting a photosensitive member when a transfer member is positioned at a second position, and a regulation unit that regulates a position of the separation member with respect to the photosensitive member, in which the regulation unit contacts the photosensitive member earlier than the contact surface in a process of inserting a cartridge in an apparatus main body.

13 Claims, 10 Drawing Sheets

IMAGE FORMING APPARATUS

BACKGROUND

Field

The present disclosure relates to an image forming apparatus, such as a copier, a printer, a facsimile apparatus, or a multifunction peripheral, that performs image formation electrophotographically.

Description of the Related Art

An image forming apparatus using an electrophotographic image forming process forms an image on a recording material, such as a sheet, as follows. First, an electrostatic latent image is formed on a photosensitive member serving as an image bearing member, the latent image is developed using developer to be visualized into a toner image, and the toner image is transferred onto the recording material at a transfer nip portion formed between the photosensitive member and a transfer member. After that, the recording material onto which the toner image is transferred is nipped at and conveyed through a fixing nip portion formed between a fixing roller and a pressure roller provided in a fixing device, so that the toner image is thermally fixed onto the recording material. In this manner, an image is formed on the recording material.

The transfer member is urged toward the photosensitive member by an urging member so that the transfer nip portion is formed between the transfer member and the photosensitive member. Thus, the transfer member is in pressure contact with the photosensitive member. For example, the image forming apparatus can be transported while the photosensitive member and the transfer member are in pressure contact with each other. In this case, when a time required for the transportation is long, the transfer member can be deformed, the transfer member can be rubbed against the photosensitive member, or softener, cross-linker, or the like that has bled from the transfer member can adhere to the photosensitive member.

Japanese Patent Laid-Open No. 2004-78212 discloses a configuration in which a separation member is inserted between a transfer member and a photosensitive member when an image forming apparatus is transported. A configuration in which, when the image forming apparatus is installed for usage, the separation member is automatically retracted and the transfer member and the photosensitive member contact each other has been proposed.

In the configuration of Japanese Patent Laid-Open No. 2004-78212, the separation member needs to contact the photosensitive member at an appropriate position so that the photosensitive member and the transfer member are separated by the separation member. In a configuration in which a cartridge including the photosensitive member is attached to or detached from a main body of the image forming apparatus, the separation member and the photosensitive member can contact each other while the separation member is shifted from a normal position in a process of inserting the cartridge depending on the way in which the separation member and the photosensitive member are made to contact. In such a state, the separated state may not be canceled correctly even when the photosensitive member rotates.

SUMMARY

The present disclosure provides an image forming apparatus in which a separation member contacts a photosensitive member at a normal position in a process of inserting a cartridge in an apparatus main body.

Aspects of the present disclosure provide an image forming apparatus, including an apparatus main body, a cartridge, including a photosensitive member bearing a toner image, that is detachably attached to the apparatus main body, a transfer member that transfers a toner image from the photosensitive member onto a recording material, the transfer member being movable between a first position so as to contact the photosensitive member and a second position so as to be farther from the photosensitive member than the first position while the cartridge is attached to the apparatus main body, and a separation member arranged on the transfer member at an end in an axial direction of the transfer member and separates the photosensitive member and the transfer member, in which the separation member moves in a first direction when the photosensitive member rotates while the transfer member is at the second position so that the transfer member moves from the second position to the first position by movement of the separation member in the first direction. The separation member includes a contact surface contacting the photosensitive member when the transfer member is at the second position and a regulation unit that regulates a position of the separation member with respect to the photosensitive member. The regulation unit contacts the photosensitive member earlier than the contact surface in a process of inserting the cartridge in the apparatus main body.

Further features will become apparent from the following description of exemplary embodiments with reference to the attached drawings.

DESCRIPTION OF THE EMBODIMENTS

With reference to drawings, exemplary embodiments will be described. Note that, sizes, materials, and shapes of components, relative positions therebetween, and the like that are described in the following embodiments are to be appropriately modified in accordance with a configuration and various conditions of an apparatus to which the present disclosure is applied. The scope of the present disclosure is not intended to be limited only to the embodiments unless specifically stated.

Embodiment 1

Figure 1:
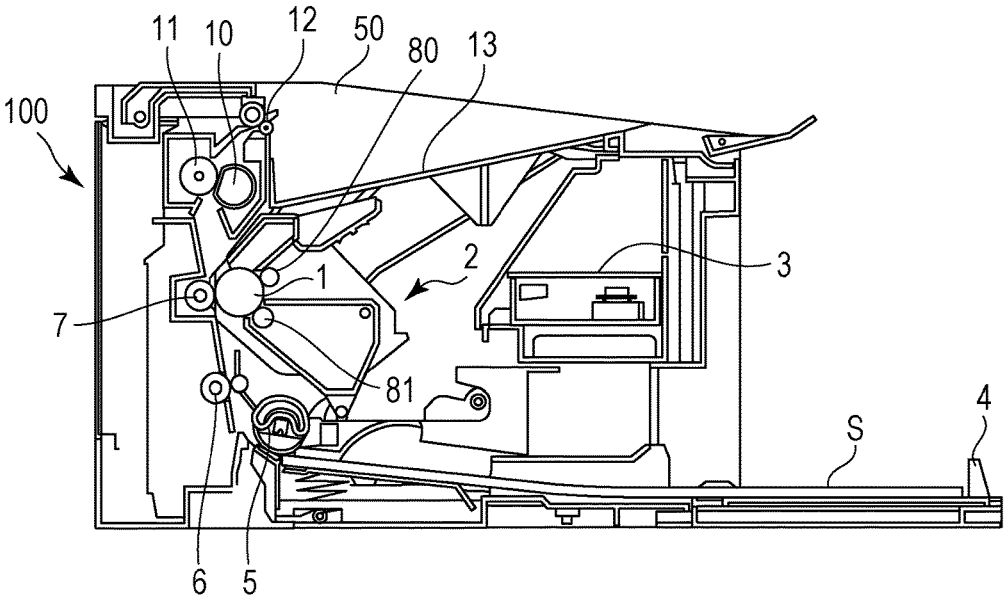
FIG. 1 is a schematic view illustrating an example of an image forming apparatus.

FIG. 1 is a schematic view illustrating an example of an image forming apparatus. An image forming apparatus 100 can electrophotographically form an image on a recording material, such as a recording sheet or an OHP sheet, in accordance with a signal transmitted from external equipment, such as a personal computer, connected to the image forming apparatus 100 so as to be able to communicate with the image forming apparatus 100. The following description is provided based on an assumption that the surfaces on the front side and the back side when a feed tray is attached to or detached from the image forming apparatus 100 are respectively set as a front surface and a rear surface, and a vertically upper surface when the image forming apparatus 100 is installed on a horizontal surface is set as an upper surface.

(Entire Configuration of Image Forming Apparatus)

FIG. 1 is a sectional view illustrating a schematic configuration of the image forming apparatus 100 according to the present embodiment. A laser beam printer 100 is illustrated as an example of the image forming apparatus 100 in FIG. 1.

The image forming apparatus (apparatus main body) 100 includes a drum-type electrophotographic photosensitive member (hereinafter, referred to as a photosensitive drum 1) as an image bearing member. The photosensitive drum 1 is formed by a cylindrical drum base made of aluminum, nickel, or the like. A photosensitive agent, such as organic photoconductor (OPC), amorphous selenium, or amorphous silicon, is provided on the cylindrical drum base. The photosensitive drum 1 is supported by the apparatus main body 100 so as to rotate freely and is driven by a driving source so as to rotate at a predetermined process speed. A charging member 80, a developing member 81, and a transfer roller 7 serving as a transfer member are provided around the photosensitive drum 1 in that order in the direction of rotation of the photosensitive drum 1. A scanner unit 3 serving as an exposure unit is provided on the right side (front side) of the photosensitive drum 1. The photosensitive drum 1, the charging member 80, and the developing member 81 integrally constitute a process cartridge 2 that is detachably attached to the apparatus main body 100.

The apparatus main body 100 also includes a feed tray 4 on which a recording material S, such as a sheet of paper, is stacked, a feeding roller 5, a conveyance roller pair 6, fixing units 10 and 11, a discharge roller pair 12, and a discharge tray 13 in order along a conveyance path for the recording material S. A control unit (not illustrated) including a power supply and an electric part that are used to drive and control components is provided inside the apparatus main body 100.

(Operation of Image Forming Apparatus)

Next, an operation of the image forming apparatus 100 will be described. The photosensitive drum 1 that is driven so as to rotate by the driving source is uniformly charged by the charging member 80 to have a predetermined polarity and a predetermined potential. The surface of the photosensitive drum 1 that has been charged is subjected to image exposure by the scanner unit 3 in accordance with image information, and electric charge on the exposed portion is removed, so that an electrostatic latent image (latent image) is formed. The electrostatic latent image is developed by the developing member 81 and visualized into a toner image. The toner image on the photosensitive drum 1 is transferred onto the recording material S by the transfer roller 7. The transfer roller 7 is urged toward the photosensitive drum 1 by an urging member described below. In such a configuration, a transfer nip portion is formed between the transfer roller 7 and the photosensitive drum 1. Thus, the transfer roller 7 performs a transfer operation for transferring the toner image on the photosensitive drum 1 (on the image bearing member) onto the recording material S at the transfer nip portion.

The recording material S stacked and stored in the feed tray 4 is fed from the feed tray 4 by the feeding roller 5. The recording material S is conveyed through the conveyance roller pair 6 to the transfer nip portion.

The toner image transferred from the photosensitive drum 1 onto the recording material S at the transfer nip portion is thermally fixed by the fixing units 10 and 11. The recording material S having passed through the fixing units 10 and 11 is discharged onto the discharge tray 13 through the discharge roller pair 12.

(Attachment/Detachment Configuration of Cartridge)

Figure 2:
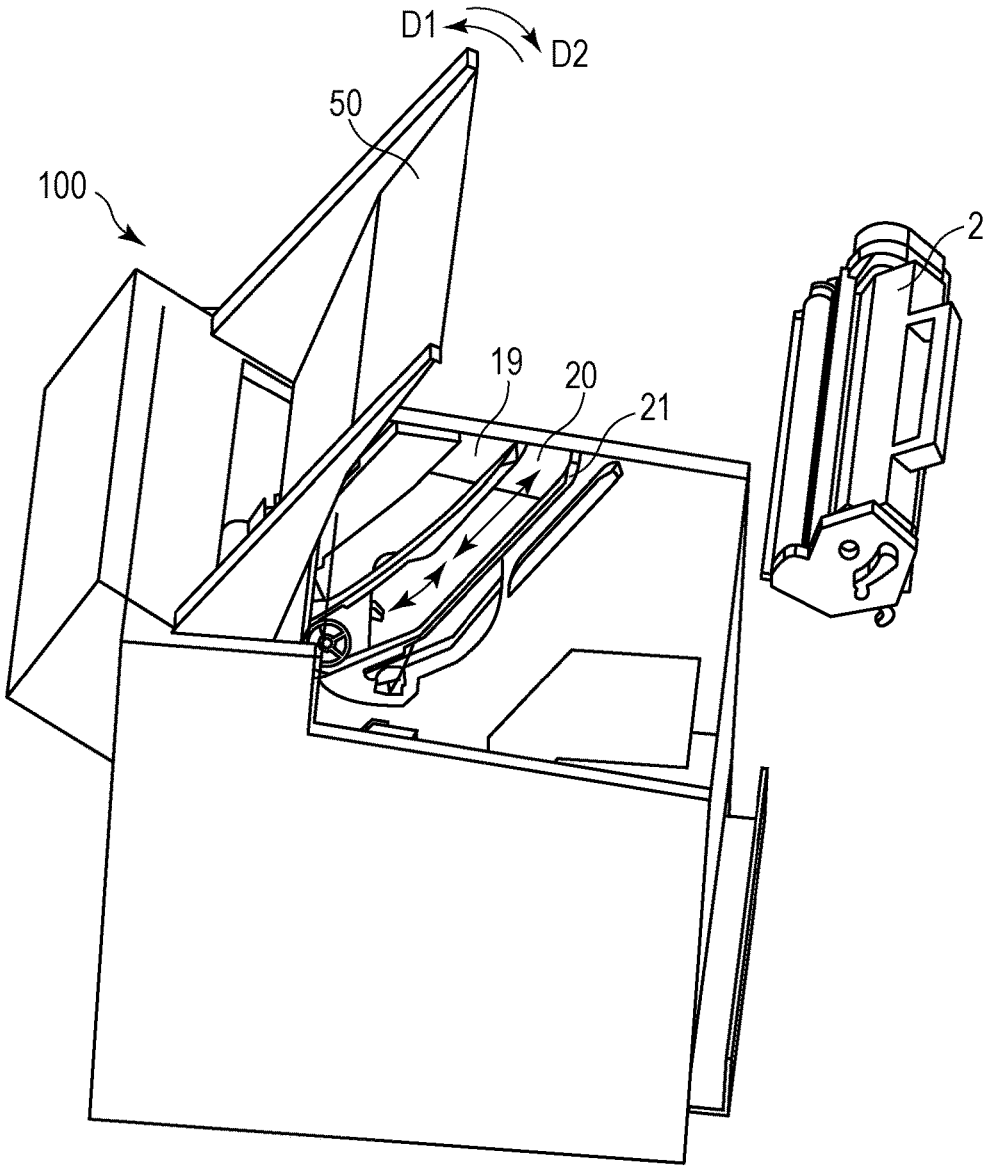
FIG. 2 is a schematic perspective view for explaining a state where a cartridge is detached from an apparatus main body.

FIG. 2 is a perspective view for explaining a state where the cartridge 2 is detached from the apparatus main body 100. As illustrated in FIG. 2, in the present embodiment, a cover (opening and closing member) 50 of the apparatus main body 100 is moved upward, so that the cartridge 2 is detachably attached to the apparatus main body 100. The cover 50 is rotatable about a rotation axis (not illustrated) in a direction D1 and a direction D2 as illustrated in FIG. 2. A guide unit 20 serving as a guiding member that guides attachment and detachment of the cartridge 2 is provided on each side of the apparatus main body 100 in a width direction (a direction crossing an attachment/detachment direction). When a unit to be guided, which is provided in the cartridge 2, is guided to the guide unit 20, the cartridge 2 is guided to a predetermined position of the apparatus main body 100.

(Separation Mechanism of Transfer Member)

Figure 3:
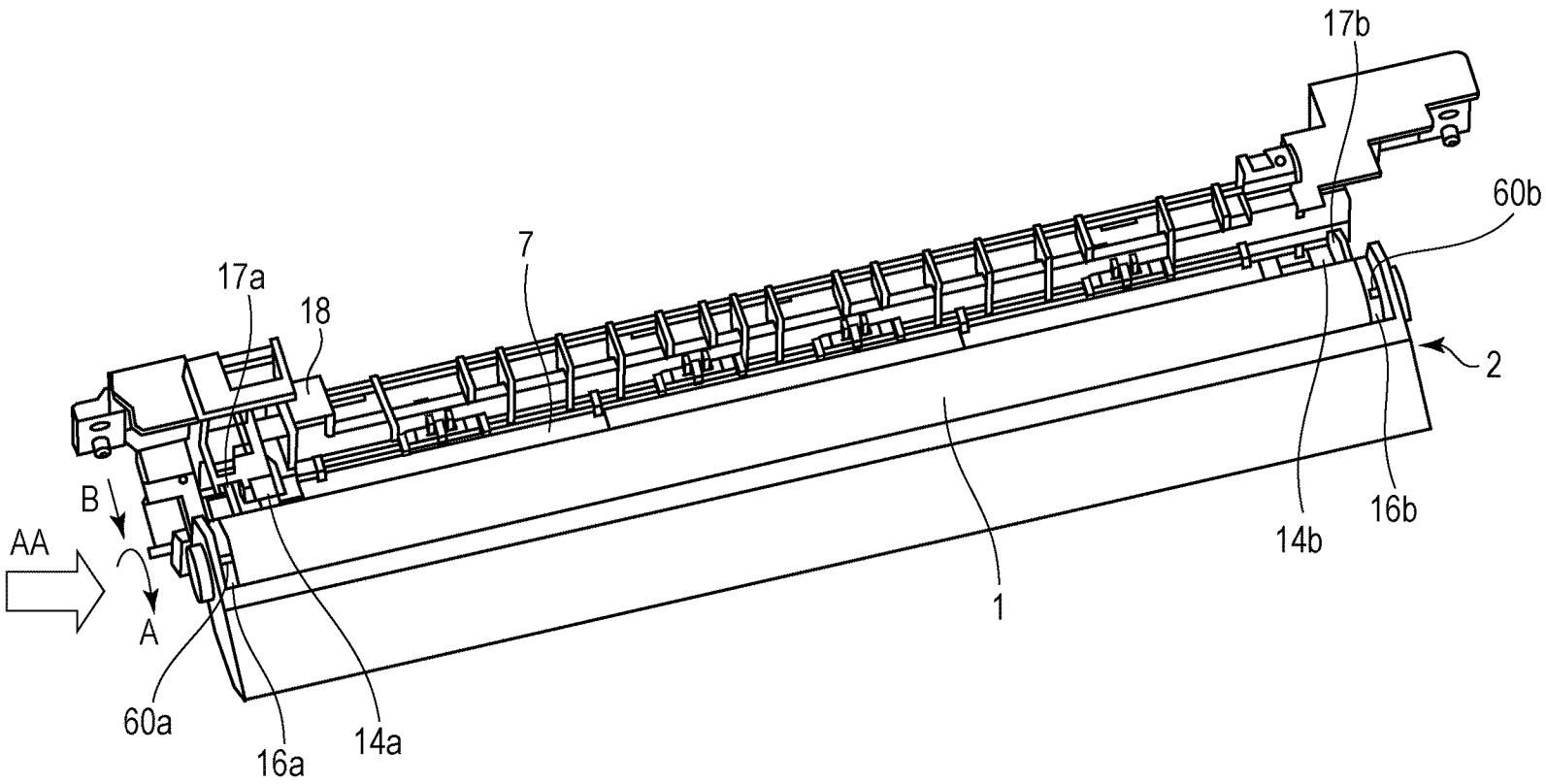
FIG. 3 is a schematic perspective view for explaining a separated state of a transfer roller and a photosensitive drum.
Figure 4:
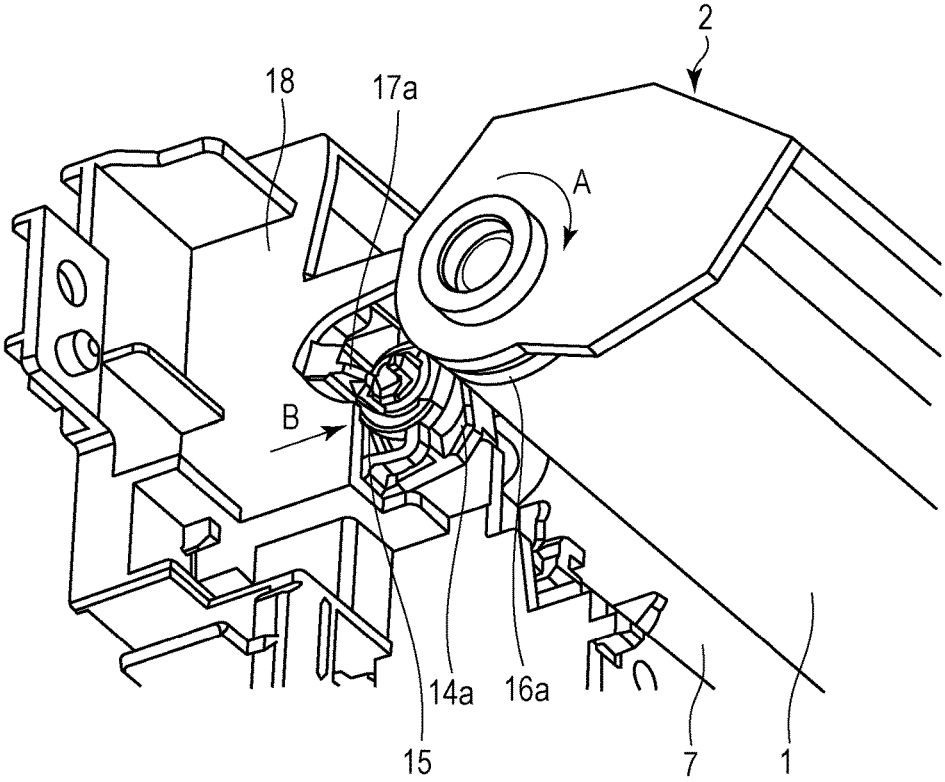
FIG. 4 is a partially enlarged view for explaining the separated state of the transfer roller and the photosensitive drum.

Next, a separation mechanism of the transfer member will be described. FIG. 3 is a schematic perspective view for explaining a separated state of the transfer roller 7 and the photosensitive drum 1. FIG. 4 is a schematic perspective view from the AA side of FIG. 3. Separation levers 17*a* and 17*b* serving as separation members, flanges 16*a* and 16*b* provided in the photosensitive drum 1, and protrusions 60*a* and 60*b* provided in the flanges 16*a* and 16*b* respectively have the same configuration and are provided on both end sides of the transfer roller 7 in an axial direction of a rotation shaft. Thus, although description is provided below for the separation lever 17*a*, the flange 16*a*, a transfer roller bearing 14*a*, and the protrusion 60*a* on one end side, the separation lever 17*b*, the flange 16*b*, a transfer roller bearing 14*b*, and the protrusion 60*b* also have similar configurations so that description thereof will be omitted.

The photosensitive drum 1 is rotatably held on the cartridge 2 and rotates in the direction of an arrow A in the Figures by drive force transmitted from the image forming apparatus 100. On the side facing the photosensitive drum 1, the transfer roller 7 is rotatably held on the transfer roller bearing 14*a* (bearing member). The transfer roller bearing 14*a* is attached so as to be translatable with respect to a frame 18 (a part of the apparatus main body 100) in a direction so as to contact the photosensitive drum 1 and is urged in a direction of an arrow B by a transfer spring 15 serving as an urging member. In such a configuration, the transfer roller 7 contacts the photosensitive drum 1 by an urging force of the transfer spring 15 to form the transfer nip portion. A position of the transfer roller 7, at which the transfer nip portion is formed, is set as a first position.

The separation member 17*a* is rotatably held on the transfer roller bearing 14*a* at one end of the rotation shaft of the transfer roller 7. The photosensitive drum 1 includes the flange 16*a* at one end in the width direction. The flange 16*a* integrally rotates with the photosensitive drum 1. The flange 16*a* is arranged at a position facing the separation member 17*a* in the width direction and is provided with the protrusion 60*a* at a part of a peripheral surface thereof.

Figure 5A:
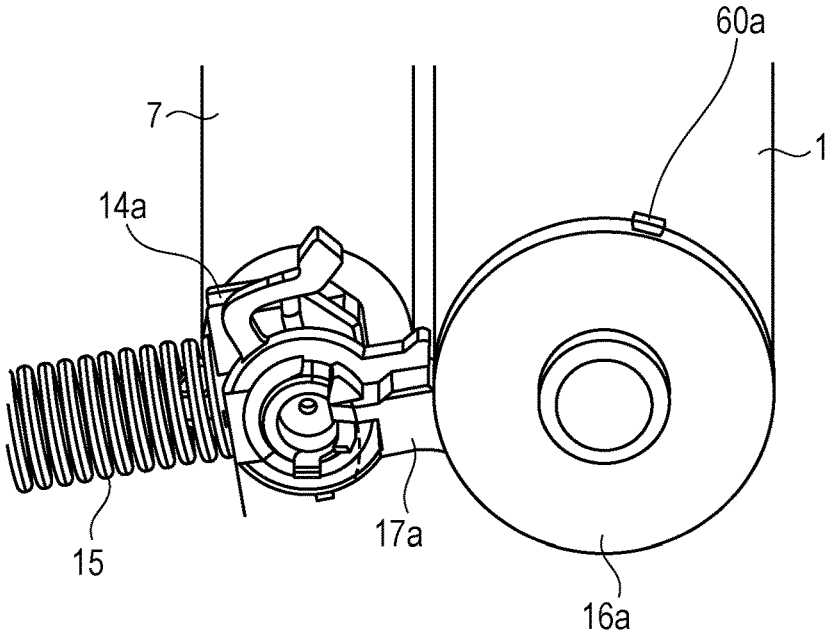
FIG. 5A is a schematic view illustrating a state where the transfer roller is separated from the photosensitive drum and FIG. 5B is a schematic view illustrating a state where the transfer roller contacts the photosensitive drum.
Figure 5B:
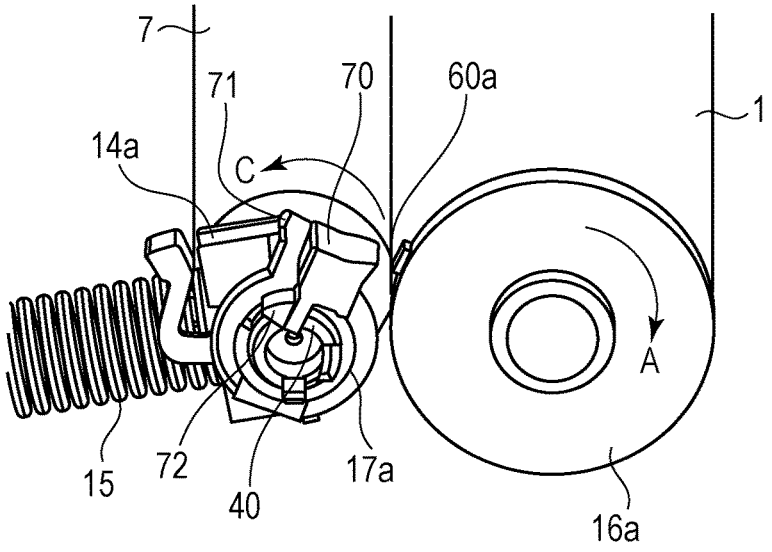

FIG. 5A is a schematic view illustrating a state where the transfer roller 7 is separated from the photosensitive drum 1 and FIG. 5B is a schematic view illustrating a state where the transfer roller 7 contacts the photosensitive drum 1. Only the photosensitive drum 1 is illustrated as the cartridge 2.

As illustrated in FIG. 5A, while the cartridge 2 is attached to the apparatus main body 100, the flange 16*a* of the photosensitive drum 1 contacts the separation member 17*a* and the transfer roller 7 is separated from the photosensitive drum 1. The transfer roller 7 can move to a second position farther from the photosensitive drum 1 than the first position. The protrusion 60*a* of the flange 16*a* is positioned in the cartridge 2 so as to not be contacting the separation member 17*a*. Such a state is defined as a separated state. When the image forming apparatus 100 is transported with the cartridge 2 attached thereto, the image forming apparatus 100 is transported in the separated state.

Next, a state where the separated state is canceled and shifted to a contact state will be described with reference to FIG. 5B. As illustrated in FIG. 5B, when the image forming apparatus 100 is turned on in the separated state, the photosensitive drum 1 rotates in the direction of the arrow A. With the rotation of the photosensitive drum 1, the flange 16*a* also rotates. With the rotation of the flange 16*a*, the protrusion 60*a* arranged at a position away from the separation member 17*a* contacts the separation member 17*a* and pushes down the separation member 17*a*. As a result, the separation member 17*a* rotates to a side in a direction of an arrow C (first direction side) and a contact surface 70, which contacts the flange 16*a* and included in the separation member 17*a*, moves in a direction away from the flange 16*a*. Since the transfer roller 7 is urged with respect to the photosensitive drum 1 by the transfer spring 15, the transfer roller 7 becomes close to the photosensitive drum 1 and is brought into a state of contacting the photosensitive drum 1 (contact state). A guiding rib 71 and a rib unit 40 illustrated in FIG. 5B are described below. The separation member 17*a* includes a locking unit 72, and when the locking unit 72 engages with the apparatus main body 100, the separation member 17*a* is positioned, and in such a state, the separation member 17*a* is retracted to a position at which the separation member 17*a* cannot contact the photosensitive drum 1.

As described above, when the contact surfaces 70 of the separation members 17*a* and 17*b* respectively contact the flanges 16*a* and 16*b* of the photosensitive drum 1, the photosensitive drum 1 and the transfer roller 7 enter a separated state.

(Shape of Separation Member)

Figure 6A:
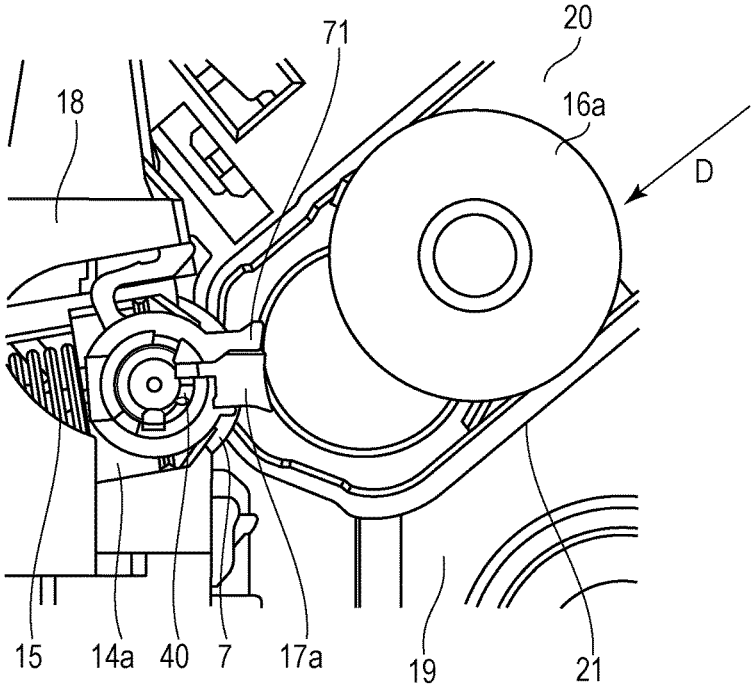
FIG. 6A is a schematic sectional view illustrating a state where the cartridge is being attached to the apparatus main body and FIG. 6B is a schematic sectional view for explaining a state where the cartridge is further inserted from the state of FIG. 6A and a separation member contacts the photosensitive drum.
Figure 6B:
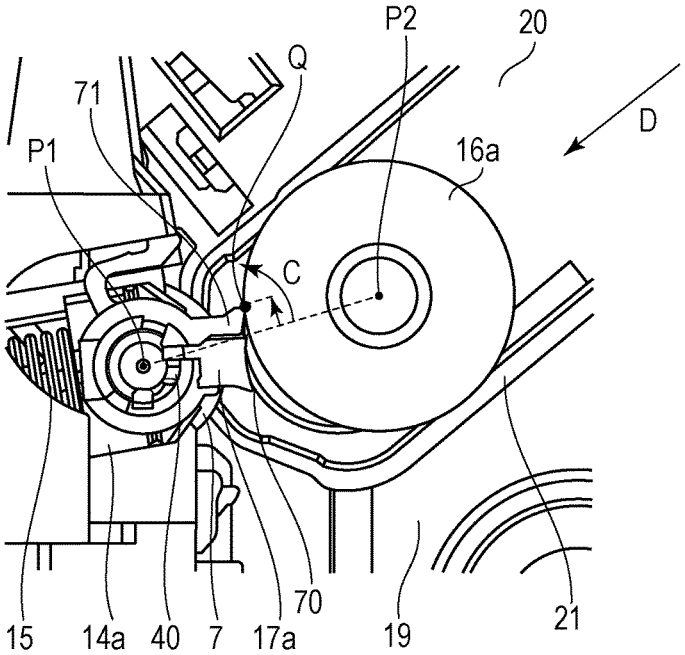

Next, a shape of the separation member 17*a* as a characteristic of the present embodiment will be described in detail. FIG. 6A is a schematic sectional view illustrating a state where the cartridge 2 is being attached to the apparatus main body 100. FIG. 6B is a schematic sectional view for explaining a state where the cartridge 2 is further inserted from the state of FIG. 6A and the separation lever 17*a* serving as the separation member contacts the photosensitive drum 1. Only the flange 16*a* is illustrated as the cartridge 2 and the other components are omitted in FIGS. 6A and 6B.

As illustrated in FIG. 6A, the cartridge 2 (the flange 16*a* in FIG. 6A) is inserted in a direction of an arrow D along the guiding unit 21 of the guide unit 20 attached to a main body frame 19. The rib unit 40 (positioning unit) is provided in the transfer roller bearing 14*a*. The separation member 17*a* contacts the rib unit 40 under the weight of the separation member 17*a* and the contact surface 70 maintains a posture (is positioned) to face the photosensitive drum 1 side.

Figure 7:
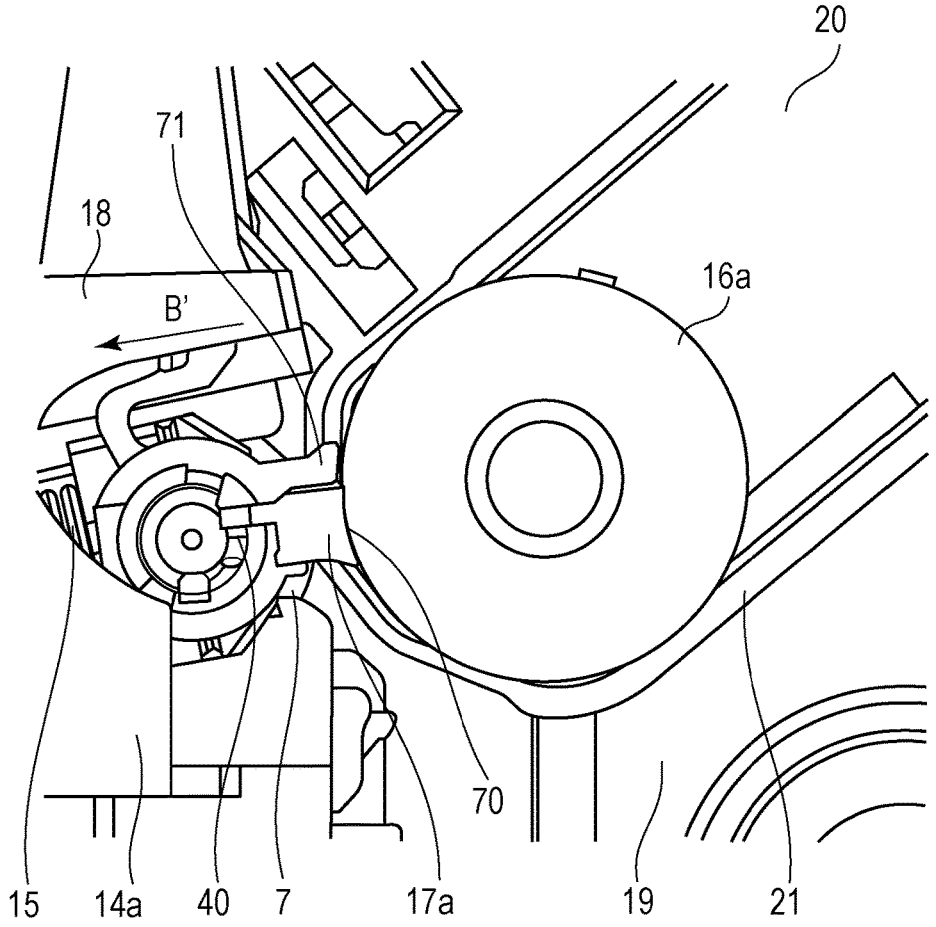
FIG. 7 is a schematic sectional view for explaining a state where the photosensitive drum presses the separation member, so that a flange and the transfer roller are separated.

The guiding rib 71 is provided in the separation member 17*a* separately from the contact surface 70. The guiding rib 71 is a regulation unit that regulates the position of the separation member 17*a*. As illustrated in FIG. 6B, in a process of inserting the cartridge 2, first, the flange 16*a* contacts the guiding rib 71. When the guiding rib 71 and the flange 16*a* contact each other, the separation member 17*a* starts to rotate in the direction of the arrow C. When the cartridge 2 is further inserted, as illustrated in FIG. 7, the contact surface 70 contacts the photosensitive drum 1, pushes out the transfer roller 7 in a direction of an arrow B', and separates from the photosensitive drum 1. As a result, the photosensitive drum 1 and the transfer roller 7 enter the separated state.

Next, a function of the guiding rib 71 will be described in detail with reference to FIGS. 5B and 6B. When the guiding rib 71 and the flange 16*a* contact each other first in the process of inserting the cartridge 2, that is, in the state of FIG. 6B, P1 denotes a rotation center of the separation member 17*a* and P2 denotes a center of the photosensitive drum 1. Q denotes a contact point of the guiding rib 71 and the flange 16*a*. The contact point Q is at a position away from a line segment (straight line), which connects P1 and P2, in the rotation direction (arrow C) of the separation member 17*a*.

When the guiding rib 71 is arranged to achieve such a positional relation, the fact acts so that the separation member 17*a* always rotates in the direction of the arrow C at a time of contacting the flange 16*a*, and the separation member 17*a* reliably contacts the flange 16*a*, that is, is brought into a stable contact state.

Figure 8:
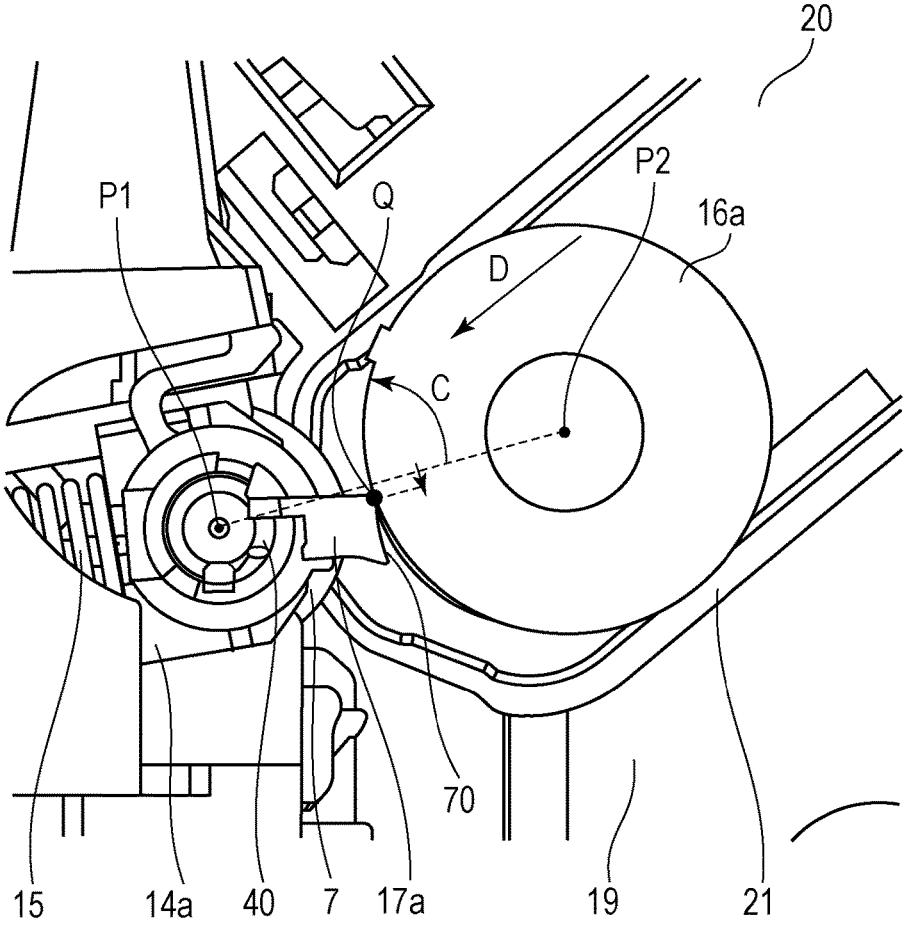
FIG. 8 is a schematic view for explaining a comparative example.

FIG. 8 is a schematic view for explaining a comparative example in which the guiding rib 71 is not provided. In the comparative example, the contact surface 70 directly contacts the flange 16*a* because there is no guiding rib 71. In FIG. 8, the contact point Q is arranged on the side opposite to the side in the case of FIG. 6B. In FIG. 8, the contact point Q of the separation member 17*a* and the flange 16*a* is at a position away from the line segment, which connects the rotation center P1 of the separation member 17*a* and the center P2 of the photosensitive drum 1, in the direction opposite to the rotation direction (arrow C) of the separation member 17*a*.

In such a positional relationship, the fact acts so that the separation member 17*a* rotates in a direction opposite to the arrow C when the separation member 17*a* and the flange 16*a* contact each other. Since the rotation of the separation member 17*a* is regulated by the rib unit 40 of the transfer roller bearing 14*a*, the separation member 17*a* cannot rotate in the direction opposite to the arrow C. As a result, the contact surface 70 of the separation member 17*a* cannot contact the flange 16*a* correctly and the transfer roller 7 cannot push through the separation member 17*a* in a direction opposite to the urging direction, so that it is difficult to form an appropriate separated state.

As described above, in a case where the guiding rib 71 contacts the flange 16*a* first when the cartridge 2 is inserted into the image forming apparatus 100, the position of the separation member 17*a* can be regulated so that the flange 16*a* is reliably supported by the contact surface 70. When the contact surface 70 contacts the flange 16*a*, the transfer roller 7 can separate from the photosensitive drum 1. The separation member 17*a* can reliably contact the photosensitive drum 1 at a correct position.

The above-described configuration enables a gap to be formed between the separation member 17*a* and the rib unit 40 of the transfer roller bearing 14*a* in the state illustrated in FIG. 7 in which the photosensitive drum 1 pushes the separation member 17*a* and the flange 16*a* and the transfer roller 7 are separated from each other. In such a configuration, the contact surface 70 of the separation member 17*a* correctly contacts the flange 16*a* even when the position of the rib unit 40 varies because of the tolerances of parts.

Figure 9:
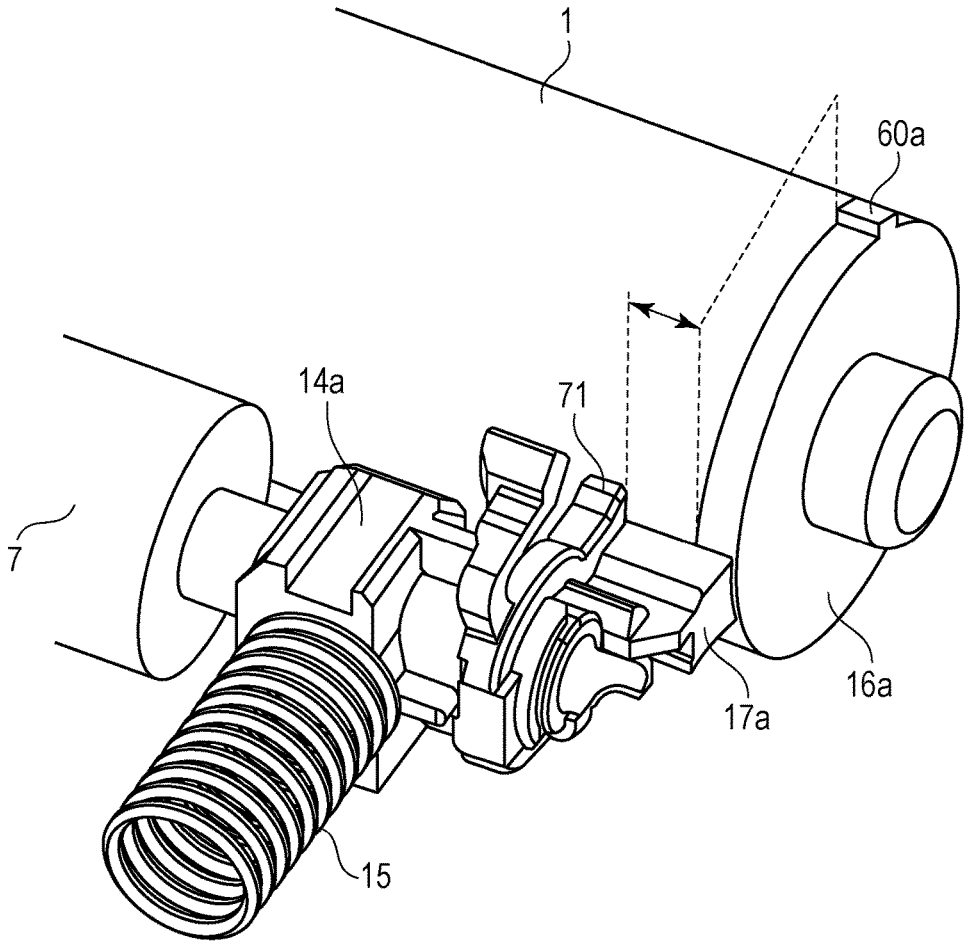
FIG. 9 is a schematic perspective view for explaining a shape of the separation member in a width direction.

FIG. 9 is a schematic perspective view for explaining a shape of the separation member 17*a* in the width direction. As illustrated in FIG. 9, the configuration is such that a width of the contact surface 70 is longer than widths of the flange 16*a* and the protrusion 60*a*. Such a configuration enables the protrusion 60*a* to reliably contact the contact surface 70 even if there is a shift in the width direction when the cartridge 2 is attached to the apparatus main body 100.

Figure 10:
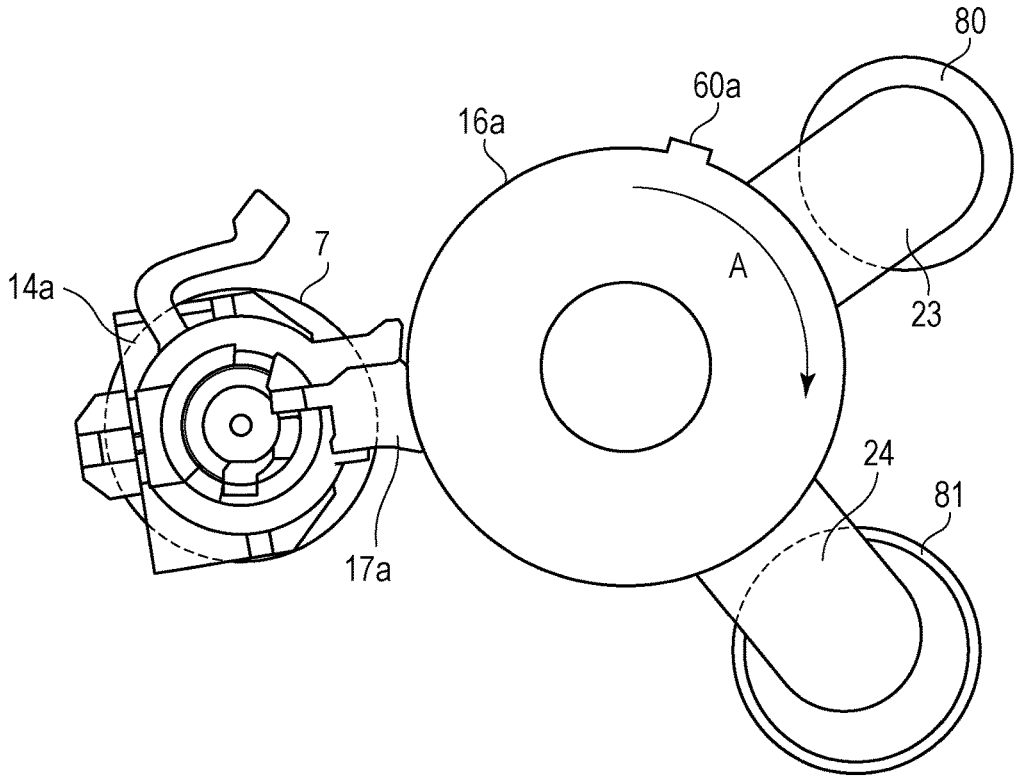
FIG. 10 is a schematic sectional view for explaining a relation between a separation unit of a process member and a protrusion.

It can be configured so that the protrusion 60*a* rotates to act on a member other than the separation member 17*a* as illustrated in FIG. 10. FIG. 10 illustrates a state where both the charging member 80 and the developing member 81, serving as process members acting on the photosensitive drum 1, are separated. The charging member 80 is separated from the photosensitive drum 1 by a separation unit 23 and the developing member 81 is separated from the photosensitive drum 1 by a separation unit 24. In this case, the protrusion 60*a* contacting the separation member 17*a* can be used as a common acting unit that acts on the separation units 23 and 24. Such a configuration enables a plurality of members to contact the photosensitive drum 1 by only moving one acting unit (protrusion 60*a*).

While exemplary embodiments have been provided, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-144642 filed Jul. 22, 2016, which is hereby incorporated by reference herein in its entirety.

What is claimed is:

1. An image forming apparatus, comprising:

an apparatus main body;

a cartridge, including a photosensitive member bearing a toner image, that is detachably attached to the apparatus main body;

a transfer member that transfers a toner image from the photosensitive member onto a recording material, the transfer member being movable between a first position so as to contact the photosensitive member and a second position so as to be separated from the photosensitive member when the cartridge is attached to the apparatus main body; and a separation member arranged on the transfer member at an end in an axial direction of the transfer member and separates the photosensitive member and the transfer member, the separation member moving in a first direction when the photosensitive member rotates while the transfer member is at the second position so that the transfer member moves from the second position to the first position by movement of the separation member in the first direction, wherein the separation member includes a contact surface contacting the photosensitive member when the transfer member is at the second position and a regulation unit that regulates a position of the separation member with respect to the photosensitive member, and wherein the regulation unit contacts the photosensitive member earlier than the contact surface in a process of inserting the cartridge in the apparatus main body.

2. The image forming apparatus according to claim 1, wherein when the regulation unit contacts the photosensitive member in the process of inserting the cartridge in the apparatus main body, the separation member moves in the first direction and the contact surface faces the photosensitive member by movement of the separation member in the first direction.

3. The image forming apparatus according to claim 1, wherein the transfer member includes a transfer roller rotatable about a rotation shaft and a bearing member that holds the rotation shaft of the transfer roller so as to rotate freely.

4. The image forming apparatus according to claim 3, wherein the bearing member includes a positioning unit that contacts the separation member, and when the separation member contacts the positioning unit under weight of the separation member, the separation member is positioned by the positioning unit.

5. The image forming apparatus according to claim 3, wherein the separation member is held on the bearing member and is rotatable with respect to the bearing member.

6. The image forming apparatus according to claim 1, wherein a first contact point of the regulation unit and the photosensitive member in the process of inserting the cartridge is at a position away from a straight line, which connects a rotation center of the separation member and a rotation center of the photosensitive member at a time of contact, in the first direction of the separation member.

7. The image forming apparatus according to claim 1, wherein the photosensitive member includes a flange arranged on the photosensitive member at an end in the axial direction and contacts the regulation unit and the contact surface.

8. The image forming apparatus according to claim 7, wherein the flange includes a protrusion that contacts the separation member when the photosensitive member rotates while the cartridge is attached, and wherein the separation member moves in the first direction when the protrusion and the separation member contact each other.

9. The image forming apparatus according to claim 8, wherein the cartridge includes a process member acting on the photosensitive member to perform image formation and a separation unit by which the process member is separated from the photosensitive member, and wherein the protrusion contacts the separation unit to make the process member, which is in a separated state, contact the photosensitive member.

10. The image forming apparatus according to claim 1, wherein the separation member includes a locking unit and when the locking unit engages with the apparatus main body, the separation member is positioned with respect to the apparatus main body and is retracted to a position at which the separation member cannot contact the photosensitive member.

11. The image forming apparatus according to claim 1, wherein the contact surface has a width greater than that of the regulation unit in the width direction.

12. The image forming apparatus according to claim 1, further comprising:

an urging member that urges the transfer member toward the photosensitive member, wherein the transfer member moves against an urging force of the urging member when moving from the first position to the second position.

13. The image forming apparatus according to claim 1, wherein the separation member is provided at each end in the axial direction.

* * * * *